US011304483B2

(12) United States Patent
McHugh

(10) Patent No.: US 11,304,483 B2
(45) Date of Patent: Apr. 19, 2022

(54) TWO-WAY SLIDE FASTENER

(71) Applicant: Michael Benjamin McHugh, Pointe-Claire (CA)

(72) Inventor: Michael Benjamin McHugh, Pointe-Claire (CA)

( * ) Notice: Subject to any disclaimer, the term of this patent is extended or adjusted under 35 U.S.C. 154(b) by 0 days.

(21) Appl. No.: 17/196,031

(22) Filed: Mar. 9, 2021

(65) Prior Publication Data

US 2021/0282510 A1 Sep. 16, 2021

Related U.S. Application Data

(60) Provisional application No. 62/990,282, filed on Mar. 16, 2020.

(51) Int. Cl.
*A44B 19/02* (2006.01)
*A44B 19/38* (2006.01)

(52) U.S. Cl.
CPC ..... *A44B 19/382* (2013.01); *A44B 19/02* (2013.01)

(58) Field of Classification Search
CPC ..... A44B 19/02; A44B 19/382
See application file for complete search history.

(56) References Cited

U.S. PATENT DOCUMENTS 782,803 A 2/1905 Watson, Jr.
1,996,626 A * 4/1935 Robinson ..... A41C 1/00 450/138
2,122,442 A 7/1938 Palmer et al.
2,519,012 A * 8/1950 Babcock ..... A44B 19/382 24/386
2,553,230 A * 5/1951 Bashover ..... A44B 19/382 24/386
2,622,248 A * 12/1952 Schaye ..... A44B 19/24 2/80
2,889,605 A * 6/1959 Morin ..... A44B 19/38 24/382
3,875,623 A 4/1975 Johnston
4,099,301 A * 7/1978 Fujisaki ..... A44B 19/36 24/386
4,492,006 A * 1/1985 Ishii ..... A44B 19/34 24/382
5,140,727 A 8/1992 Dais et al.
5,273,511 A 12/1993 Boeckman
5,758,868 A 6/1998 Shea
5,813,094 A * 9/1998 Perez, II ..... A44B 19/00 24/381
5,934,806 A 8/1999 Tomic
6,195,852 B1 * 3/2001 Kusayama ..... A44B 19/382 24/434
6,493,909 B2 * 12/2002 Paul ..... A41F 1/00 24/381

(Continued)

FOREIGN PATENT DOCUMENTS

DE 102013109704 3/2015
FR 101025 6/1952

(Continued)

*Primary Examiner* — Jason W San

(57) ABSTRACT

A slide fastener including two stringers and a pair of sliders mounted to one of the stringers. When first separated from each other, the first and second stringers can be secured to each other using the sliders starting at either end thereof. Also, a garment extender including the slide fastener.

16 Claims, 10 Drawing Sheets

(56) References Cited

U.S. PATENT DOCUMENTS

| | | | | |
|---|---|---|---|---|
| 6,742,225 | B2 * | 6/2004 | Marty | A41D 15/04 24/382 |
| 6,775,885 | B1 * | 8/2004 | Wang | A44B 19/382 24/385 |
| 7,979,965 | B2 | 7/2011 | Lo | |
| 8,719,977 | B2 * | 5/2014 | Rabbany | A47G 9/0238 5/500 |
| 8,806,726 | B1 | 8/2014 | Lo | |
| 10,537,142 | B2 | 1/2020 | McHugh | |
| 11,019,861 | B2 * | 6/2021 | Picot | A41D 13/129 |
| 2005/0268438 | A1 * | 12/2005 | Chung | A44B 19/262 24/386 |
| 2006/0282998 | A1 * | 12/2006 | Kusayama | A44B 19/382 24/434 |
| 2010/0107300 | A1 * | 5/2010 | Yiu | A41D 1/21 2/85 |
| 2010/0138973 | A1 | 6/2010 | Summons | |
| 2012/0151654 | A1 * | 6/2012 | Chopak | A44B 19/382 2/69.5 |
| 2012/0260468 | A1 * | 10/2012 | Nozaki | A44B 19/382 24/386 |
| 2013/0061434 | A1 * | 3/2013 | Hampton | A44B 19/20 24/415 |
| 2014/0189930 | A1 * | 7/2014 | Solomon | A41D 3/02 2/69 |
| 2015/0366313 | A1 * | 12/2015 | Hsu | A45C 13/103 24/30.5 L |
| 2017/0079345 | A1 * | 3/2017 | Garner | A41D 15/00 |
| 2019/0261702 | A1 | 8/2019 | McHugh | |
| 2020/0107593 | A1 * | 4/2020 | McHugh | A41D 15/00 |
| 2020/0345117 | A1 * | 11/2020 | Wang | A45C 5/14 |

FOREIGN PATENT DOCUMENTS

| | | |
|---|---|---|
| GB | 2561522 | 10/2018 |
| WO | 2016109761 | 12/2015 |

* cited by examiner

TWO-WAY SLIDE FASTENER

FIELD OF THE INVENTION

The present invention relates to the general field of fasteners, and is more specifically concerned with a two-way slide fastener.

BACKGROUND

Some garment extenders are used, for example, to temporarily extend a garment, such as a jacket or a coat, during pregnancy. These garment extenders are attached between the two halves of an already present garment slide fastener of the garment. These garment extenders also often include their own extender slide fastener that is used to open and close the garment, with the garment extender remaining attached to the garment slide fastener.

Due the morphological changes occurring during pregnancy, such garment extenders typically have a wide portion and a narrow portion. The wide portion is located at the bottom of the garment, to accommodate the expanding belly of the pregnant woman, and the narrow portion is provided at the top of the garment. Once the baby is born, one may wish to extend the garment to accommodate the bulge created by the baby carried in a baby carrier under the garment. Since the baby is usually carried over the chest in such baby carriers, the wide portion and narrow portions would ideally switch position when the garment extender is used to extend the garment to carry the baby.

Switching the narrow and wide portions of the garment extender however results in switching the bottom and top edges of the garment extender. Since conventional slide fasteners can only be joined to each other at a single extremity after having been disengaged, if the extender slide fastener is configured to engage from the bottom during pregnancy, the same slide fastener will be switched upside/down when the garment extender is flipped for baby carrying, which will result in an unnatural top to bottom engagement of the slide fastener.

Accordingly, there exists a need for an improved slide fastener. It is a general objective of the present invention to provide such an improved slide fastener.

SUMMARY OF THE INVENTION

In a broad aspect, the invention provides a slide fastener comprising: a first stringer, the first stringer including a first tape defining first tape first and second ends, a plurality of first teeth being provided along the first tape between the first tape first and second ends; a second stringer, the second stringer including a second tape defining second tape first and second ends, a plurality of second teeth being provided along the second tape between the second tape first and second ends; first and second sliders, the first slider defining a first channel defining first channel wide and narrow ends, the second slider defining a second channel defining second channel wide and narrow ends, the first slider being operative for meshing to each other the first and second teeth when the first and second teeth move together in the first channel from the first channel wide end to the first channel narrow end and for separating from each other the first and second teeth when the first and second teeth move together in the first channel from the first channel narrow end to the first channel wide end, the second slider being operative for meshing to each other the first and second teeth when the first and second teeth move together in the second channel from the second channel wide end to the second channel narrow end and for separating from each other the first and second teeth when the first and second teeth move together in the second channel from the second channel narrow end to the second channel wide end; the first and second sliders being mounted to the first teeth with the first and second channel narrow ends facing each other; wherein the first tape is provided with a retainer pin at each end thereof preventing the first and second sliders from sliding out of the first stringer; and wherein the second tape is provided with a separable pin at each of the tape first and second ends, the separable pins being each reversibly insertable through both the first and second channels when the first and second sliders abut against each other to attach the first and second stringers to each other or to allow detachment of the first and second stringers from each other.

Advantageously, the proposed slide fastener may be attached or detached from both ends thereof.

In another broad aspect, there is provided a garment extender including a body and a pair of opposed garment attachments for attaching the body to a garment, the body including the slide fastener as described above for allowing an intended user to open or close the garment without detaching the garment extender from the garment.

In yet another broad aspect, there is provided a slide fastener comprising: a first stringer, the first stringer including a first tape defining first tape first and second ends, a plurality of first teeth being provided along the first tape between the first tape first and second ends; a second stringer, the second stringer including a second tape defining second tape first and second ends, a plurality of second teeth being provided along the second tape between the second tape first and second ends; first and second sliders, the first slider defining a first channel defining first channel wide and narrow ends, the second slider defining a second channel defining second channel wide and narrow ends, the first slider being operative for meshing to each other the first and second teeth when the first and second teeth move together relative to the first channel from the first channel wide end to the first channel narrow end and for separating from each other the first and second teeth when the first and second teeth move together relative to the first channel from the first channel narrow end to the first channel wide end, the second slider being operative for meshing to each other the first and second teeth when the first and second teeth move together relative to the second channel from the second channel wide end to the second channel narrow end and for separating from each other the first and second teeth when the first and second teeth move together relative to the second channel from the second channel narrow end to the second channel wide end; the first and second sliders being mounted to the first stringer with the first and second channel narrow ends facing each other, the first and second channel wide ends facing respectively the first tape first and second ends. With the first and second stringers detached from each other, the first and second stringers are attachable to each other by inserting the second stringer in the first and second channels and then meshing together the first and second teeth using one of the first and second sliders while starting at either one of the first tape first and second ends.

There may also be provided a slide fastener wherein, with the first and second stringers attached to each other and the first and second sliders respectively at the first tape first and second ends, the first and second stringers are detachable from each other by moving both the first and second sliders adjacent either one of the first tape first and second ends and then removing the second stringer from the first and second channels.

There may also be provided a slide fastener wherein, with the first and second stringers positioned adjacent each other, the first and second stringers are alternatively securable to each other in a first direction by moving the first and second sliders to the first tape first end, inserting the second stringer first in the second channel and then in the first channel, and subsequently moving the second slider towards the first tape second end; and securable to each other in a second direction by moving the first and second sliders to the first tape second end, inserting the second stringer first in the first channel and then in the second channel, and subsequently moving the first slider towards the first tape first end.

There may also be provided a slide fastener wherein the first tape is provided with a retainer pin at each end thereof preventing the first and second sliders from sliding out of the first stringer; and wherein the second tape is provided with a separable pin at each of the tape first and second ends, the separable pins being each insertable through both the first and second channels when the first and second sliders abut against each other to attach the first and second stringers to each other and removable from both the first and second channels when the first and second sliders abut against each other to detach the first and second stringers from each other.

There may also be provided a slide fastener wherein the retainer pin includes a pin body of substantially constant thickness therealong and a retainer protruding from the pin body to produce a thicker portion thicker than the remainder of the retainer pin.

There may also be provided a slide fastener wherein the retainer and separable pins have substantially identical pin lengths.

There may also be provided a slide fastener wherein the pin lengths are substantially equal to a combined length of the first and second channels.

In yet another broad aspect, there is provided a garment extender comprising: a body, the body defining opposed body first and second ends and body first and second sides extending therebetween, the body first and second sides being provided each with a respective attachment for attaching the garment extender to a garment; the body including body first and second panels and a slide fastener between the body first and second panels extending between the body first and second ends to allow selective attachment of the body first and second panels to each other and detachment of the body first and second panels from each other; the slide fastener including: a first stringer, the first stringer including a first tape secured to the body first panel and defining first tape first and second ends respectively at the body first and second ends, a plurality of first teeth being provided along the first tape between the first tape first and second ends; a second stringer, the second stringer including a second tape secured to the body second panel and defining second tape first and second ends respectively at the body first and second ends, a plurality of second teeth being provided along the second tape between the second tape first and second ends; first and second sliders, the first slider defining a first channel defining first channel wide and narrow ends, the second slider defining a second channel defining second channel wide and narrow ends, the first slider being operative for meshing to each other the first and second teeth when the first and second teeth move together relative to the first channel from the first channel wide end to the first channel narrow end and for separating from each other the first and second teeth when the first and second teeth move together relative to the first channel from the first channel narrow end to the first channel wide end, the second slider being operative for meshing to each other the first and second teeth when the first and second teeth move together relative to the second channel from the second channel wide end to the second channel narrow end and for separating from each other the first and second teeth when the first and second teeth move together relative to the second channel from the second channel narrow end to the second channel wide end; the first and second sliders being mounted to the first stringer with the first and second channel narrow ends facing each other, the first and second channel wide ends facing respectively the first tape first and second ends. With the first and second stringers detached from each other, the first and second stringers are attachable to each other by inserting the second stringer in the first and second channels and then meshing together the first and second teeth using one of the first and second sliders while starting at either one of the first tape first and second ends.

There may also be provided a garment extender wherein, with the first and second stringers attached to each other and the first and second sliders respectively at the first tape first and second ends, the first and second stringers are detachable from each other by moving both the first and second sliders adjacent either one of the first tape first and second ends and then removing the second stringer from the first and second channels.

There may also be provided a garment extender wherein, with the first and second stringers positioned adjacent each other, the first and second stringers are alternatively securable to each other in a first direction by moving the first and second sliders to the first tape first end, inserting the second stringer first in the second channel and then in the first channel, and subsequently moving the second slider towards the first tape second end; and securable to each other in a second direction by moving the first and second sliders to the first tape second end, inserting the second stringer first in the first channel and then in the second channel, and subsequently moving the first slider towards the first tape first end.

There may also be provided a garment extender wherein the first tape is provided with a retainer pin at each end thereof preventing the first and second sliders from sliding out of the first stringer; and wherein the second tape is provided with a separable pin at each of the tape first and second ends, the separable pins being each insertable through both the first and second channels when the first and second sliders abut against each other to attach the first and second stringers to each other and removable from both the first and second channels when the first and second sliders abut against each other to detach the first and second stringers from each other.

There may also be provided a garment extender wherein the body tapers in a direction leading from the body first end towards the body second end.

There may also be provided a garment extender wherein the slide fastener is a first slide fastener, the body further comprising a body third panel and a second slide fastener similar to the first slide fastener between the body second and third panels extending between the body first and second ends to allow selective attachment of the body second and third panels to each other and detachment of the body second and third panels from each other.

There may also be provided a garment extender wherein the first stringers of the first and second slide fasteners are both mounted to the second panel on opposite sides thereof and wherein the second stringers of the first and second slide fasteners are mounted respectively to the body first and third panels.

There may also be provided a garment extender wherein the second stringers of the first and second slide fasteners are both mounted to the second panel on opposite sides thereof and wherein the first stringers of the first and second slide fasteners are mounted respectively to the body first and third panels.

There may also be provided a garment extender wherein the first stringers of the first and second slide fasteners are mounted respectively to the second and third panels, and wherein the second stringers of the first and second slide fasteners are mounted respectively to the body first and second panels.

There may also be provided a garment extender wherein the second panel defines opposed second panel first and second faces, the second panel first and second faces being made of different materials.

There may also be provided a garment extender wherein the second panel first and second faces are respectively waterproof and made of a soft to touch material.

Other objects, advantages and features of the present invention will become more apparent upon reading of the following non-restrictive description of preferred embodiments thereof, given by way of example only with reference to the accompanying drawings.

DETAILED DESCRIPTION

The term "substantially" is used throughout this document to indicate variations in the thus qualified terms. These variations are variations that do not materially affect the manner in which the invention works and can be due, for example, to uncertainty in manufacturing processes or to small deviations from a nominal value that do not cause significant changes to the invention. These variations are to be interpreted from the point of view of the person skilled in the art. Also, directional terminology such as front, top and side, refer to a person standing up and wearing the proposed garment extender attached to a garment, such as a coat and or a jacket. This terminology is used for convenience purpose and should not be interpreted to restrict the scope of the invention.

Figure 1:
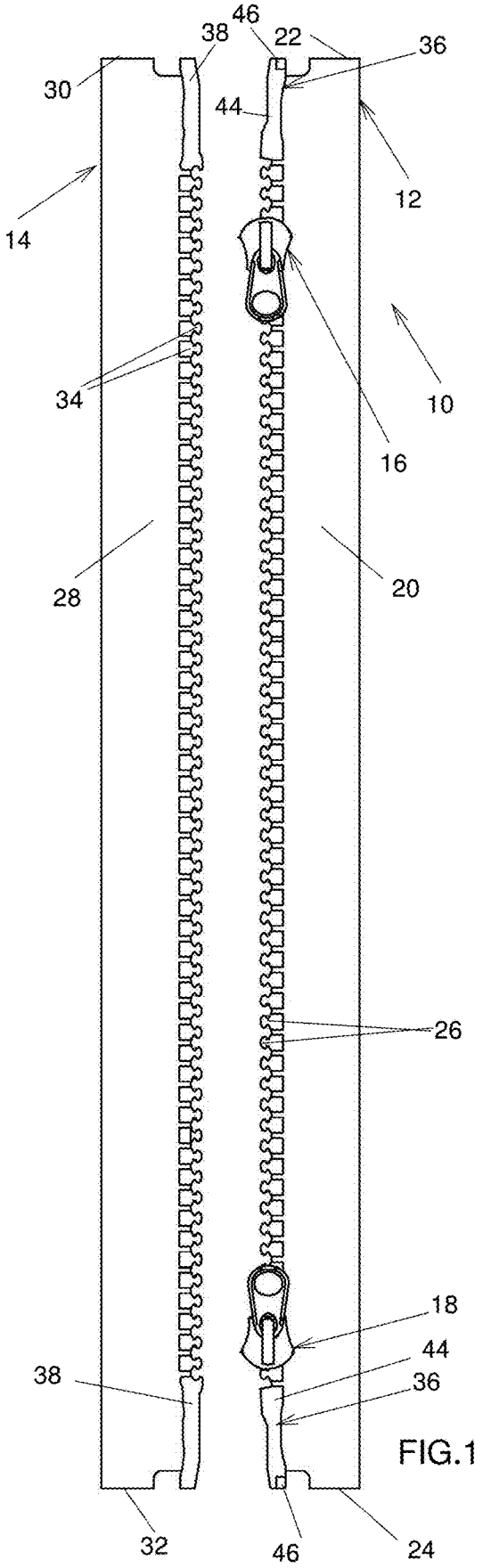
FIG. 1, in a front elevation view, illustrates a slide fastener in accordance with an embodiment of the present invention, the slider fastener being here shown with both stringers thereof detached from each other.

Referring for example to FIG. 1, there is shown a slide fastener 10 in accordance with an embodiment of the present invention. The slide fastener 10 is similar in many respects to slide fasteners known as zippers. The slide fastener 10 includes first and second stringers 12 and 14 and first and second sliders 16 and 18. The first and second sliders 16 and 18 are mounted to the first stringer 12, typically permanently. When the first and second sliders 16 and 18 are moved to any one of the ends of the first stringer 12, the second stringer can be engaged with the first and second sliders 16 and 18 to secure the first and second stringers 12 and 14 to each other. This is in opposition to conventional two-way slide fasteners which include stringers that can only be secured to each other when the sliders are at a specific one of the two ends of the fastener. To that effect, the first stringer is devoid of a retainer block that is commonly used in slide fasteners, and instead typically show a complete mirror symmetry along its length.

More specifically, the first stringer 12 includes a first tape 20 defining first tape first and second ends 22 and 24, a plurality of first teeth 26 being provided along the first tape 20 between the first tape first and second ends 22 and 24. Similarly, the second stringer 14 includes a second tape 28 defining second tape first and second ends 30 and 32, a plurality of second teeth 34 being provided along the second tape 28 between the second tape first and second ends 30 and 32.

In the embodiment shown in the drawings, the first and second sliders 16 and 18 are mounted permanently to the first stringer 12. To prevent the first and second sliders 16 and 18 from becoming detached from the first stringer 12, the first tape 20 is provided with a retainer pin 36 at each of the first tape first and second ends 22 and 24. The second stringer 14 is provided with a separable pin 38 at each of the second tape second tape first and second ends 30 and 32. The retainer and separable pins 36 and 38 typically have substantially identical lengths, which is typically about the combined length of the channels 40 (seen in FIG. 5) of the first and second sliders 16 and 18.

Figure 5:
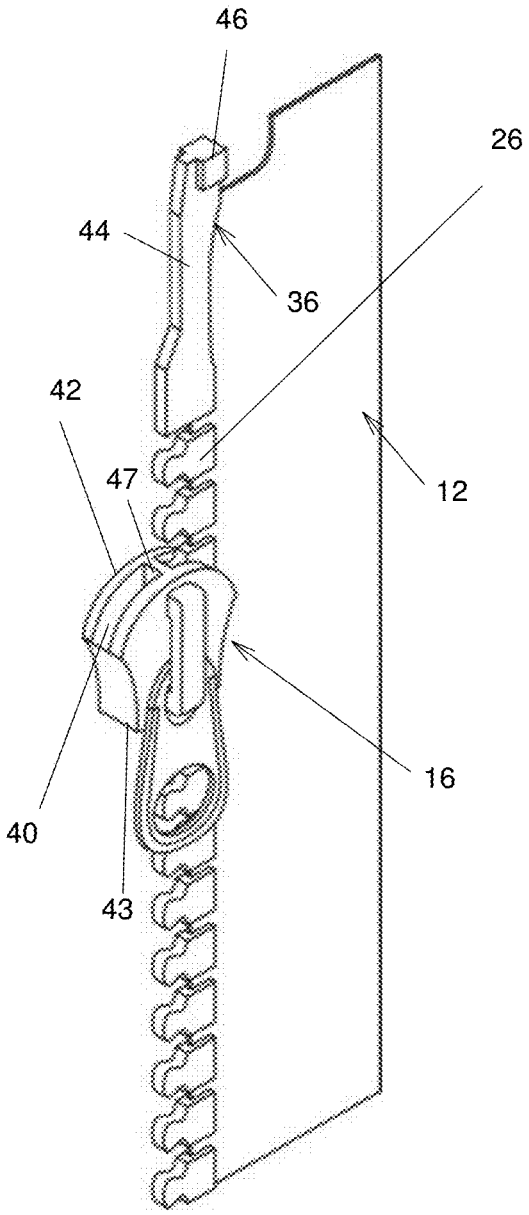
FIG. 5, in a perspective view, illustrates a slider adjacent a retainer pin all part of the slide fastener of FIG. 1.

The first and second teeth 26 and 34 and the first and second sliders 16 and 18 may be conventional teeth and sliders used commonly in the art of slide fasteners. Typically, the first and second sliders 16 and 18 are similar to each other. Referring to FIG. 5, in which only the first slider 16 is seen, the first and second sliders 16 and 18 each define a Y-shaped channel 40 defining substantially opposed channel wide and narrow ends 42 and 43. The channel 40 is typically split by a member 47 extending thereacross along a relatively small part thereof at the channel wide end 42 to define the Y shape of the channel 40, but similar channels devoid of the member 47 are usable in alternative embodiments. As in a conventional slide fastener, each of the first and second sliders 16 and 18 is operative for meshing to each other the first and second teeth 26 and 34 when the first and second teeth 26 and 34 move relative to the channel 40 from the channel wide end 42 to the channel narrow end 43 and for separating from each other the first and second teeth 26 and 34 when the first and second teeth 26 and 34 move together relative the channel 40 from the channel narrow end 43 to the channel wide end 42. Typically, it is the first and second sliders 16 and 18 that are moved relative to an intended user to create this relative movement. The first and second sliders 16 and 18 are mounted to the first tape 20 16, and more specifically to the first teeth 26 with their channel narrow ends 43 facing each other. While conventional teeth and sliders are usable in the slide fastener 10, any other suitable teeth and slide fastener having the right functionality could also be used.

The separable pins 38 are similar to conventional separable pins and are made of a substantially rigid elongated piece of material that extends in prolongation of the second teeth 34 and that is small enough to relatively easily enter the channels 40 of the first and second sliders 16 and 18. The separable pins 38 are each reversibly insertable through both channels 40 of the first and second sliders 16 and 18 when the first and second sliders 16 and 18 abut against each other to attach the first and second stringers 12 and 14 to each other or to allow detachment of the first and second stringers 12 and 14 from each other. Typically, the separable pins 38 are substantially elongated and have a constant thickness therealong, thickness referring to measurements in a direction perpendicular to the second tape 32.

The retainer pins 36 each include a retainer pin body 44 similar in shape and dimensions to the separable pin 38, and typically of a constant thickness therealong, but are also provided with a retainer 46 protruding from the retainer pin body 44, for example perpendicularly to the plane in which the channel 40 is formed, which therefore creates a thicker portion in the retainer pin 36 that is thicker than the remainder of the retainer pin 36. The retainer 46 and the channel 40 are configured and sized so that the retainer 46 is unable to travel through the whole channel 40, which prevents the first and second sliders 16 and 18 from detaching from the first stringer 12. In some embodiments, the retainer 46 protrudes from the retainer pin body 44 to an extent preventing the retainer 46 from entering the channel 40, and therefore maintains the first and second sliders 16 and 18 on the first stringer 12. In other embodiments, the retainer 46 may enter the channel 40, but a ledge (not shown in the drawings) protruding inside the channel 40 prevents the retainer 46 from travelling through the whole channel 40. The ledge is also configured and sized to allow movements relative to the first stringer 12 when the retainer 46 is away from the ledge. The retainer pin body 44 and the separable pin 38 are sized to fit both simultaneously and jointly in the channel 40, typically substantially snugly and adjacent to each other at the channel narrow end 43.

Figure 2:
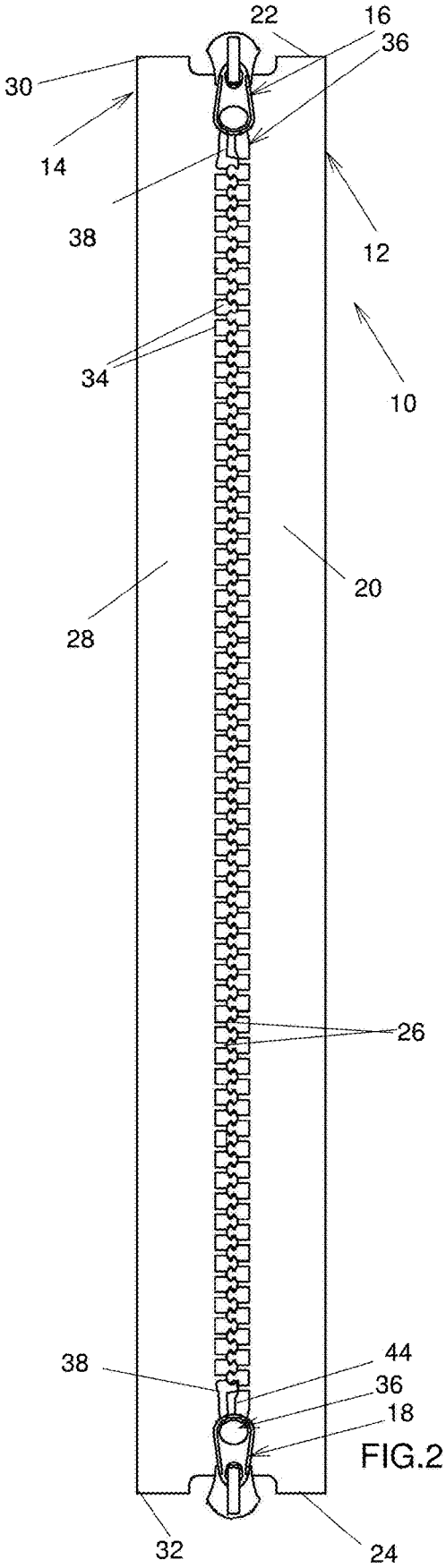
FIG. 2, in a front elevation view, illustrates the slide fastener of FIG. 1, the slider fastener being here shown with both stringers thereof completely attached to each other.
Figure 3:
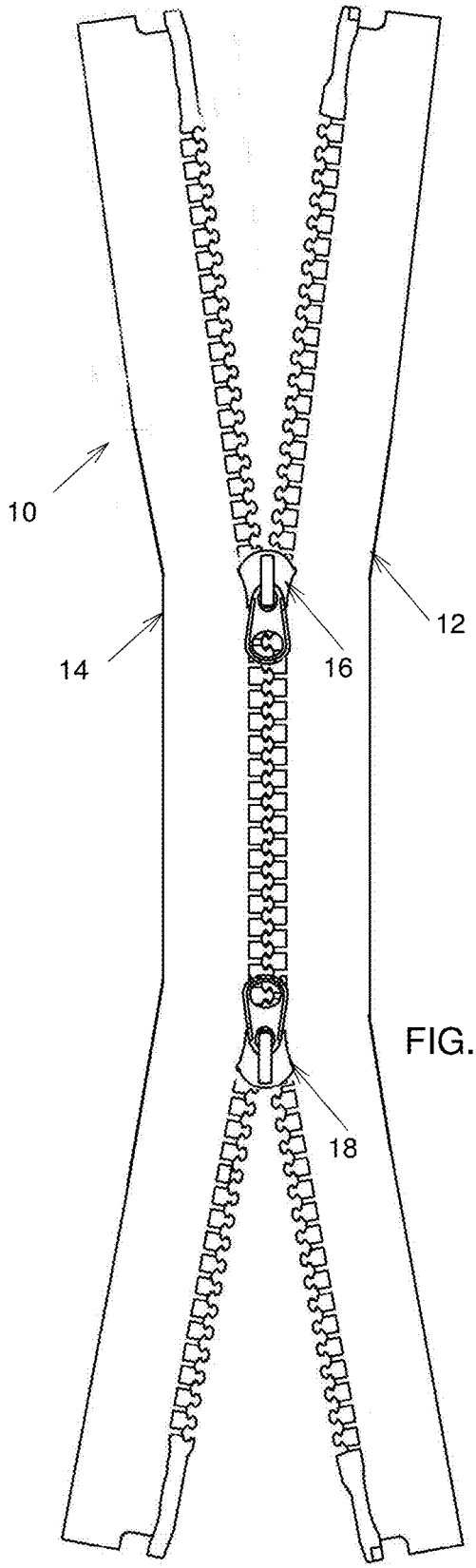
FIG. 3, in a front elevation view, illustrates the slide fastener of FIG. 1, the slider fastener being here shown with both stringers thereof partially attached to each other, in a portion away from both ends of the slide fastener.
Figure 4:
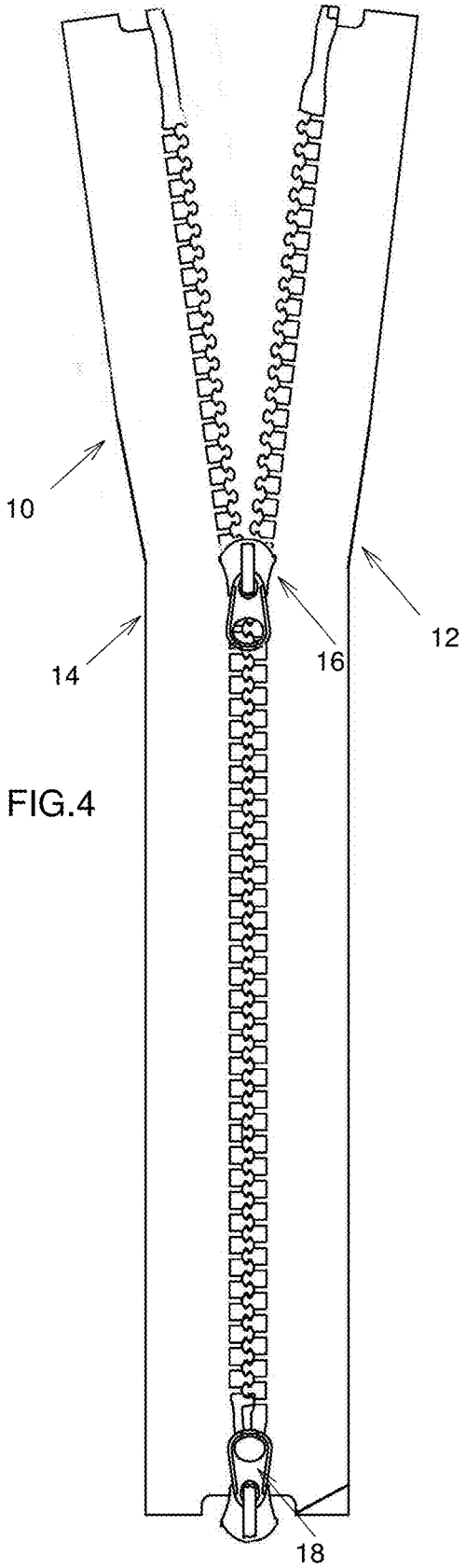
FIG. 4, in a front elevation view, illustrates the slide fastener of FIG. 1, the slider fastener being here shown with both stringers thereof partially attached to each other, in a bottom portion thereof.
Figure 6:
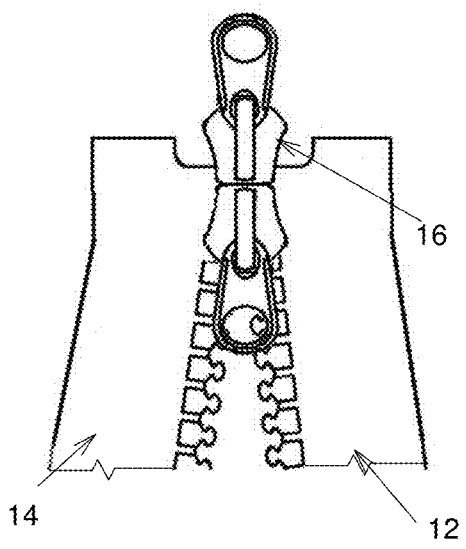
FIG. 6, in a partial front elevation view, illustrates the slide fastener of FIG. 1, the slider fastener being here shown with both stringers thereof attached to each other only at the top end thereof.

When initially detached from each other, the first and second stringers 12 and 14 are attachable to each other by inserting the second stringer 14 in the channels 40 of the first and second sliders 16 and 18 (as seen in FIG. 6, the channel 40 not being visible in FIG. 6) and then meshing together the first and second teeth 26 and 34 using one of the first and second sliders 16 or 18 while starting at either one of the first tape first and second ends 22 or 24. In other words, if a garment or other clothing is worn vertically, an intended user can attach and close the slide fastener 10 from either one of its end. More specifically, to attach the first and second stringers 12 and 14 to each other, one simply moves the first and second sliders 16 and 18 so that the first and second sliders 16 and 18 abut against one another and one of the first and second sliders 16 or 18 abuts against one of the retainers 46, at either the first 22 or 24, with the retainer 46 either abutting against the first or second slider 16 or 18, or with the retainer 46 abutting against a ledge located in the channel 40. Then, the corresponding separable pin 38 is approached towards the channel wide end 42 of the one from the first and second sliders 16 and 18 that is further from the retainer 46 and inserted through both channels 40 of the first and second sliders 16 and 18. Afterwards, the first and second sliders 16 and 18 can be moved independently from each other along the thus joined first and second stringers 12 and 14 to fully join the first and second stringers 12 and 14 to each other along their whole length, as seen in FIG. 2, or to allow the first and second stringers 12 and 14 to separate from each other at one of both of their respective ends, as seen in FIGS. 3 and 4. Complete detachment of the first and second stringers 12 and 14 from each other proceeds by simply moving both the first and second sliders 16 and 18 as much as is allowed by the retainers 46 to either the first tape first or second end 22 or 24, and removing the separable pin 38 from the channel 40.

Figure 7:
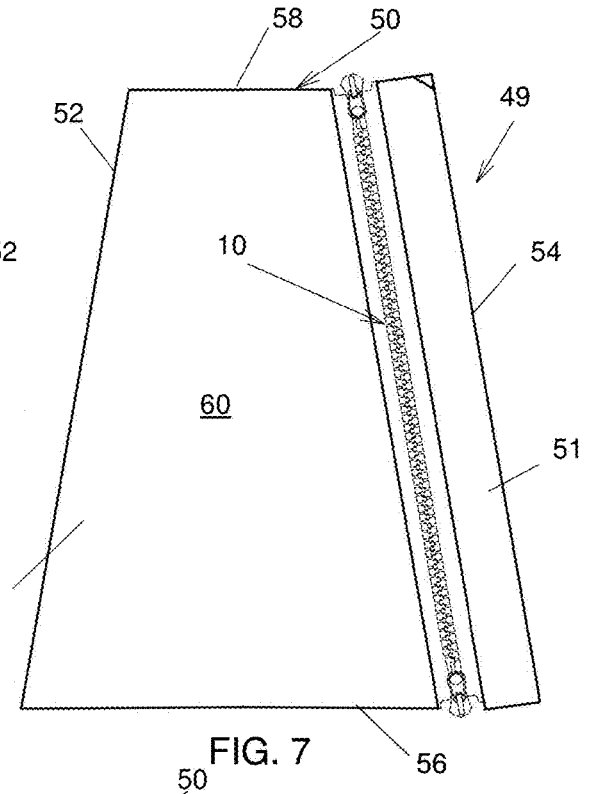
FIG. 7, in a front elevation view, illustrates a garment extender in accordance with an embodiment of the invention incorporating the slide fastener of FIG. 1.
Figure 10:
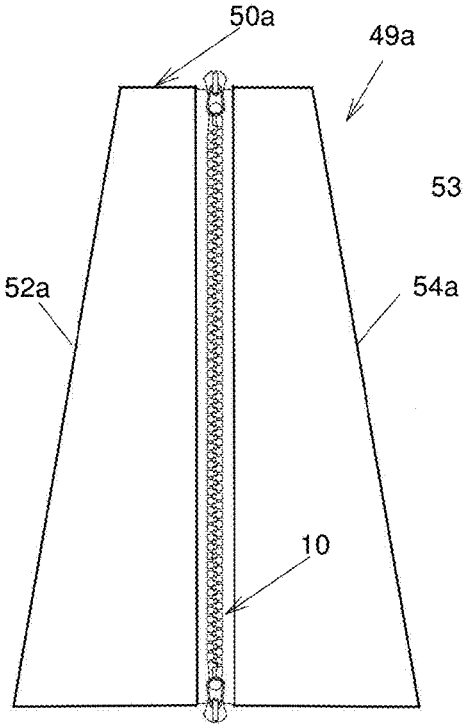
FIG. 10, in a front elevation view, illustrates a garment extender in accordance with another embodiment of the invention incorporating the slide fastener of FIG. 1.
Figure 11:
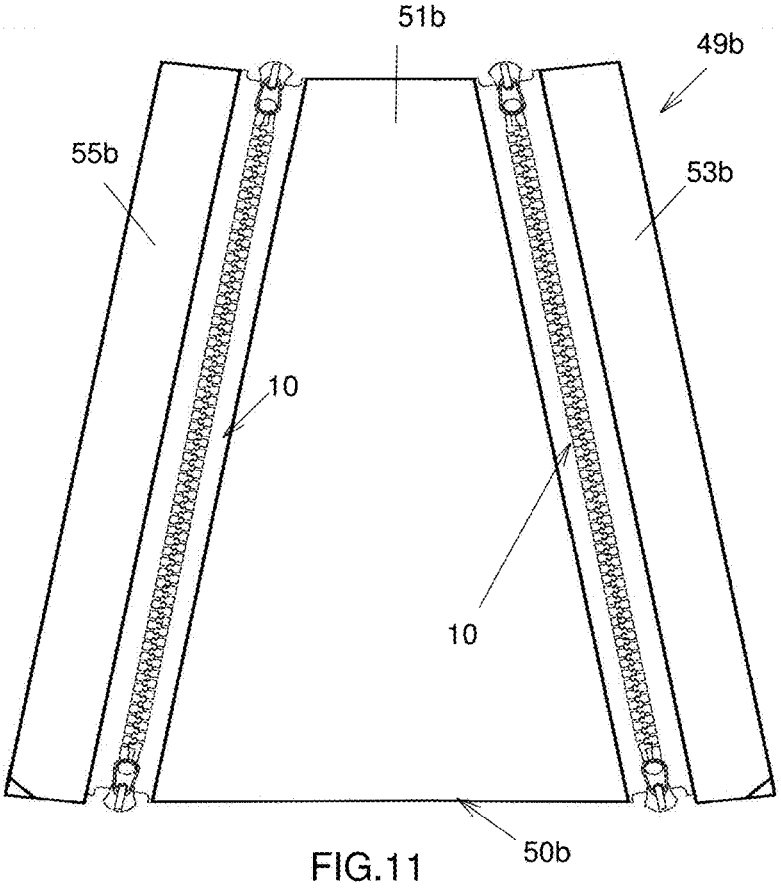
FIG. 11, in a front elevation view, illustrates a garment extender in accordance with yet another embodiment of the invention incorporating two slide fasteners of FIG. 1.
Figure 12:
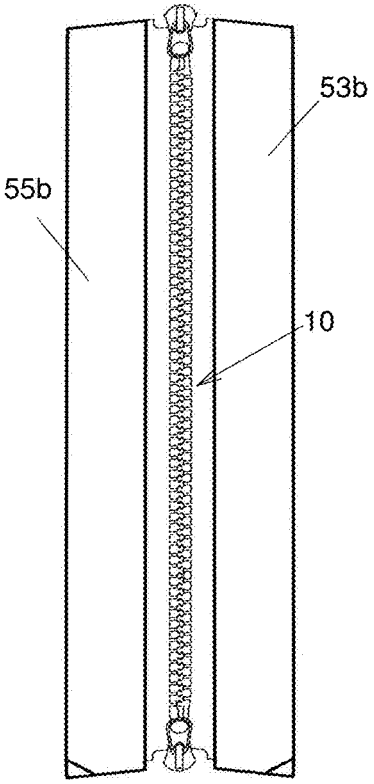
FIG. 12, in a front elevation view, illustrates the garment extender of FIG. 11 with a central portion thereof between the two slide fasteners omitted and the two slide fasteners having their remaining halves secured to each other.
Figure 13:
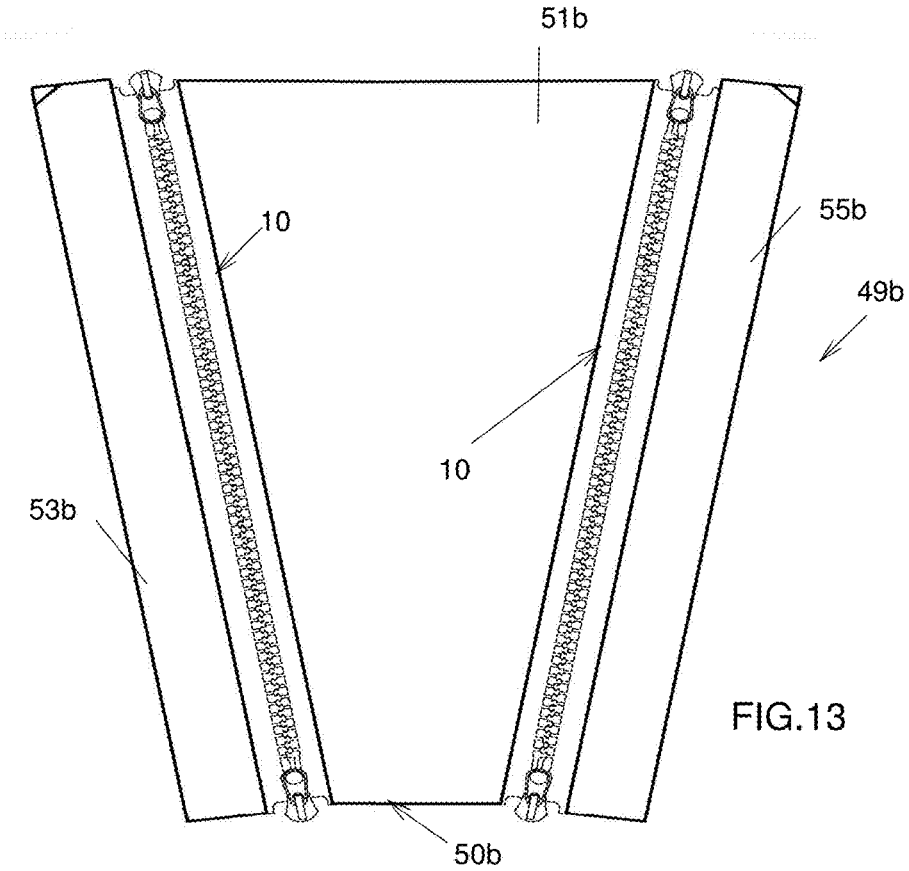
FIG. 13, in a front elevation view, illustrates the garment extender of FIG. 11 rotated 180 degrees about an axis perpendicular to the drawing sheets, so that the top and bottom ends of the garment extender have switched places.

FIG. 7 illustrates a body 50 of a garment extender 49 that uses the slide fastener 10. The garment extender 49 usually includes the body 50 and attachments (not seen in FIG. 7) usable to attach the body 50 to a garment 70 (illustrated schematically only in FIG. 22), such as a jacket or a coat. The attachments are provided at the body first and second sides 52 and 54 and may for example include slide fasteners matching the slide fastener of the garment or clips, among other possibilities. The body 50 also defines body first and second ends 56 and 58. The body includes body first and second panels 51 and 53. The slide fastener 10 is provided in the body 50 between the body first and second panels 51 and 53 and between the body first and second ends 56 and 58 and allows to detach the body first and second panels 51 and 53 from each other. The slide fastener 10 may for example split the body 50 asymmetrically, such that the body 50 is separated into two panels of different width when the slide fastener 10 is detached. However, as seen in FIG. 10, the slide fastener 10 may also be provided in an alternative body 50*a* midway between the body first and second sides 52*a* and 54*a*. Also, the body 50*b* may incorporate more than one slide fastener 10, as seen in the garment extender 49*b* of FIGS. 11 and 13. In this latter case, when a central panel 51*b* of the body 50*b*, that is the portion located between the two slide fasteners 10, is removed, the remaining side panels 53*b* and 55*b* of the body 50*b* may be used in some embodiments to form a narrower extender, as seen in FIG. 12, as the two remaining halves of the slide fasteners 10 may form themselves a slide fastener 10.

Figure 8:
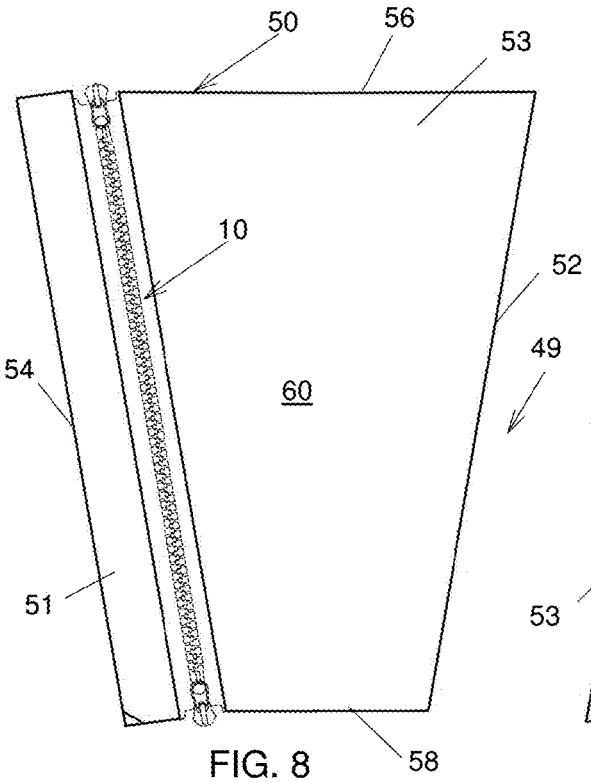
FIG. 8, in a front elevation view, illustrates the garment extender of FIG. 7 rotated 180 degrees about an axis perpendicular to the drawing sheets, so that the top and bottom ends of the garment extender have switched places.
Figure 9:
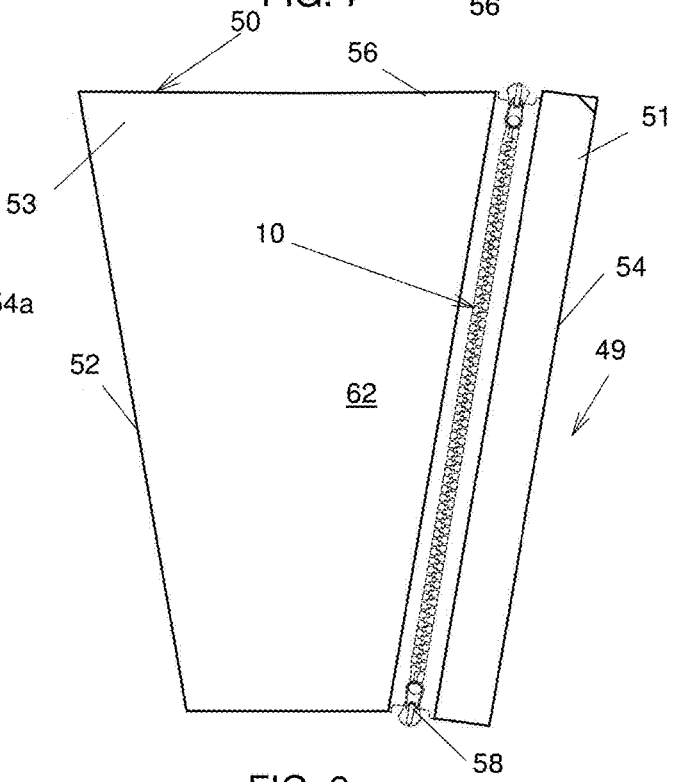
FIG. 9, in a front elevation view, illustrates the garment extender of FIG. 7 with the left part of the body thereof flipped 180 degrees about an axis parallel to the drawing sheets, so that the top and bottom ends of this part of the body have switched places.

The body 50 is wider at the body first end 56 than at the body second end 58, and therefore tapers in a direction leading from the body first end 56 towards the body second end 56. The body 50 typically tapers uniformly between the body first and second ends 56 and 58, forming a trapezoid. The body 50 defines opposed body first and second surfaces 60 and 62, seen respectively in FIGS. 7 and 9 for example. The body 50 may be rotated 180 degrees, as seen in FIG. 8, or have one if its halves flipped front to back, as seen in FIG. 9, to switch the positions of the body first and second ends 56 and 58. If the body first and second surfaces 60 and 62 have different properties, for example with the body first surface 60 weather proof and the body second surface 62 made of a soft material, rotation as in FIG. 8 may be preferable. If the body first and second surfaces have similar properties, flipping, as in FIG. 9, or rotation, as in FIG. 8, may be used to wear the garment extender 49 with the body first and second ends switching position. Due to the completely symmetrical nature of the slider fastener 10 in the direction leading between the body first and second ends 56 and 58, the slide fastener 10 may be attached or detached at the end thereof that is at the bottom when the garment to which the body 50 is attached is worn, irrespective of which one of the body first and second ends 56 and 58 is at the bottom.

Figure 14:
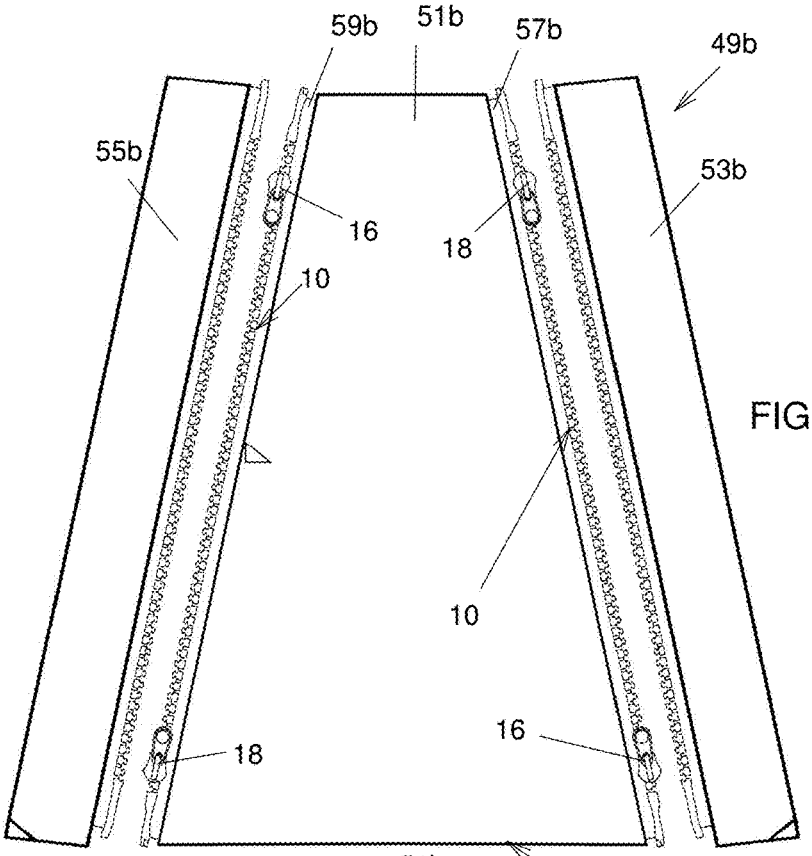
FIGS. 14 and 15 together illustrate flipping of the body central portion of a first configuration of the garment extender of FIG. 11.

Referring for example to FIG. 14, the central portion 51*b* defines laterally opposed central portions sides 57*b* and 59*b*. The central portion 51*b* is joined to opposed lateral portions 53*b* and 55*b* of the body 50*b* at the central portion sides 57*b* and 59*b* through the slide fasteners 10.

Figure 15:
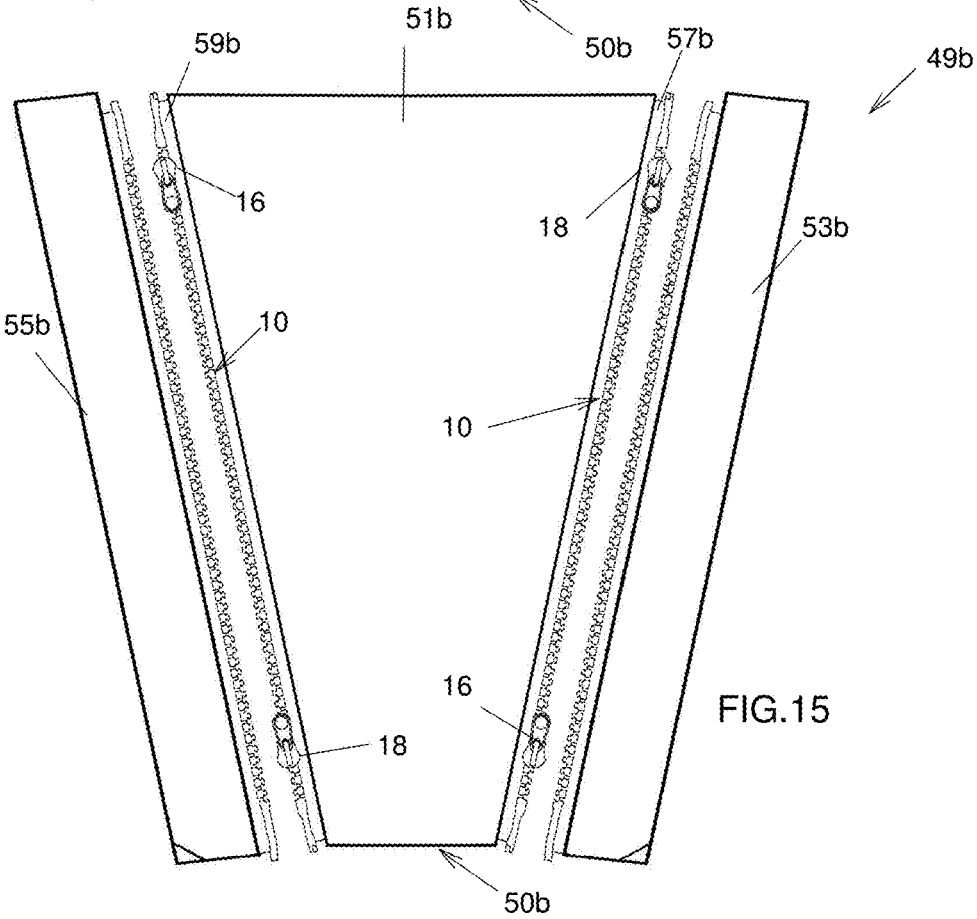
Figure 16:
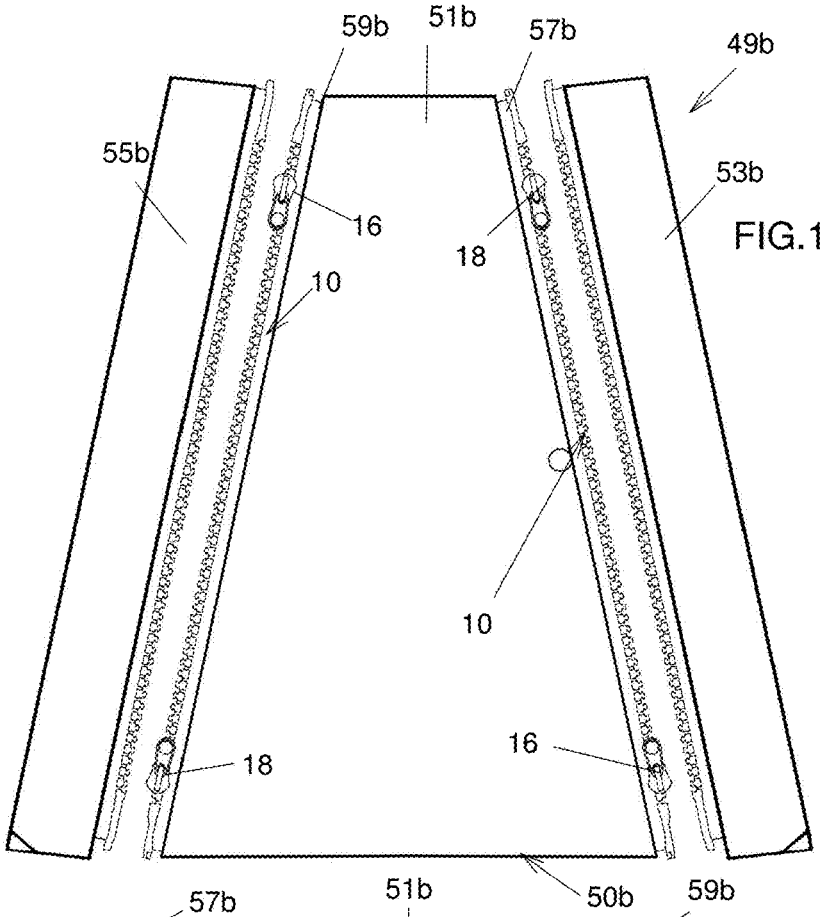
FIGS. 16 and 17 together illustrate rotation of the body central portion of the first configuration of the garment extender of FIG. 11.
Figure 17:
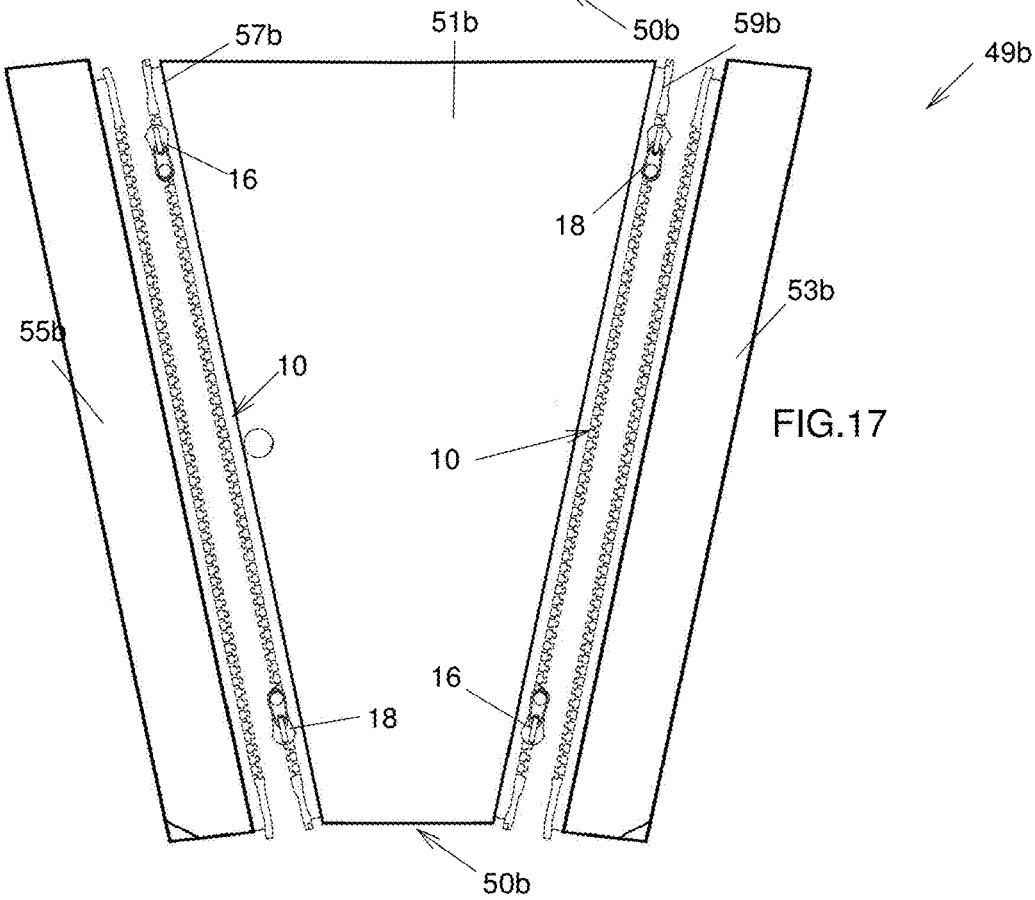

The garment extender 49*b* may have two different general configurations. In the first configuration the central portion 51*b* may include the first and second sliders 16 and 18 at both central portion sides 57*b* and 59*b* (as seen for example in FIG. 14), or omit the first and second sliders 16 and 18 at both central portion sides 57*b* and 59*b* (not shown in the drawings). The first and second sliders 16 and 18 are then either omitted on the lateral portions 53*b* and 55*b* or present on both the lateral portions 53*b* and 55*b* to form complete slide fasteners 10. In this configuration, the slide fastener 10 halves located at opposed central portion sides 57*b* and 59*b* are identical to each other. The central portion 51*b* may be rotated without flipping front to back (as seen by comparing FIGS. 16 and 17) or flipped front to back (as seen by comparing FIGS. 14 and 15) to exchange the bottom and top ends of the central portion 51*b* with each other without removing the lateral portions 53*b* and 55*b* from the garment.

Figure 18:
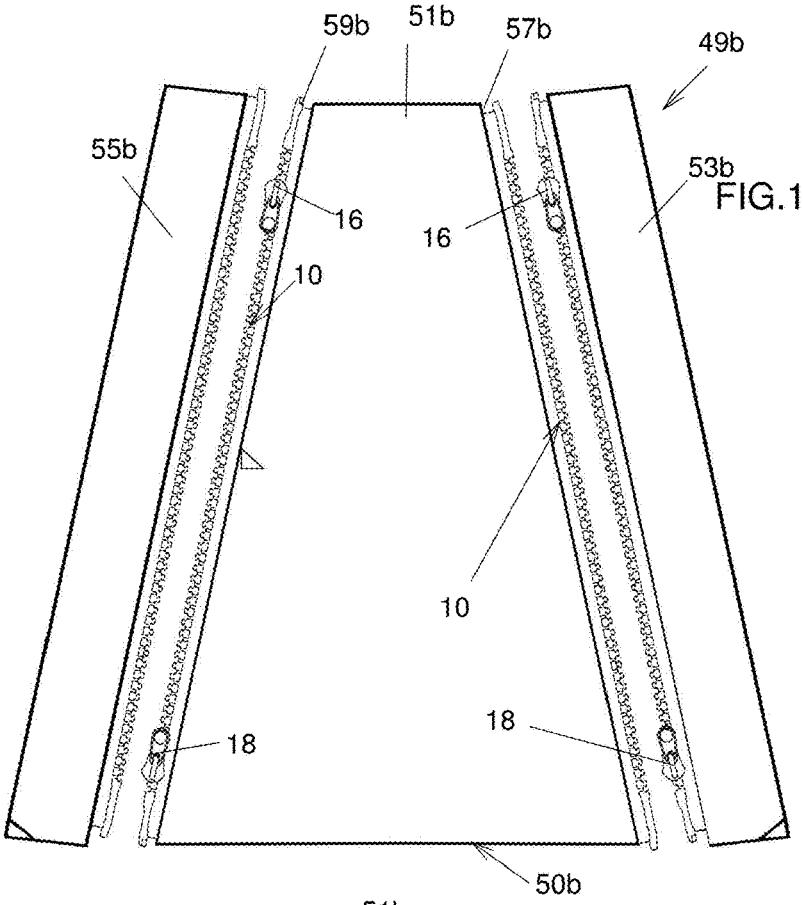
FIGS. 18 and 19 together illustrate flipping of the body central portion of of a second configuration of the garment extender of FIG. 11.
Figure 19:
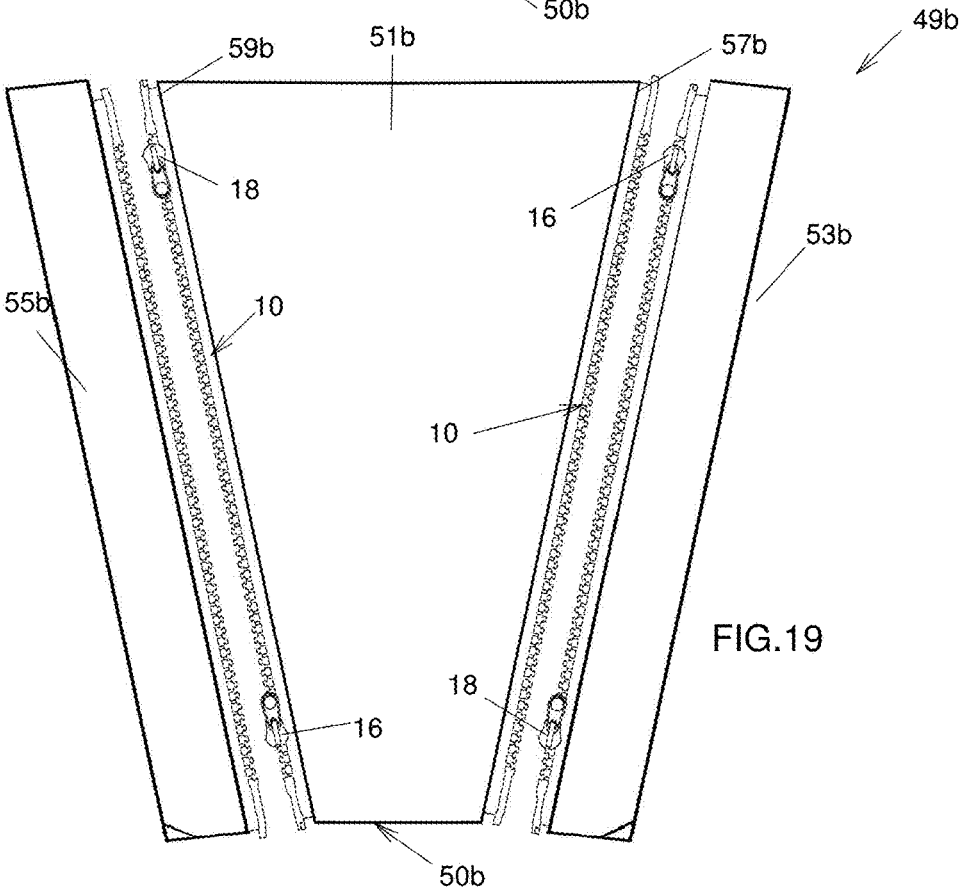
Figure 20:
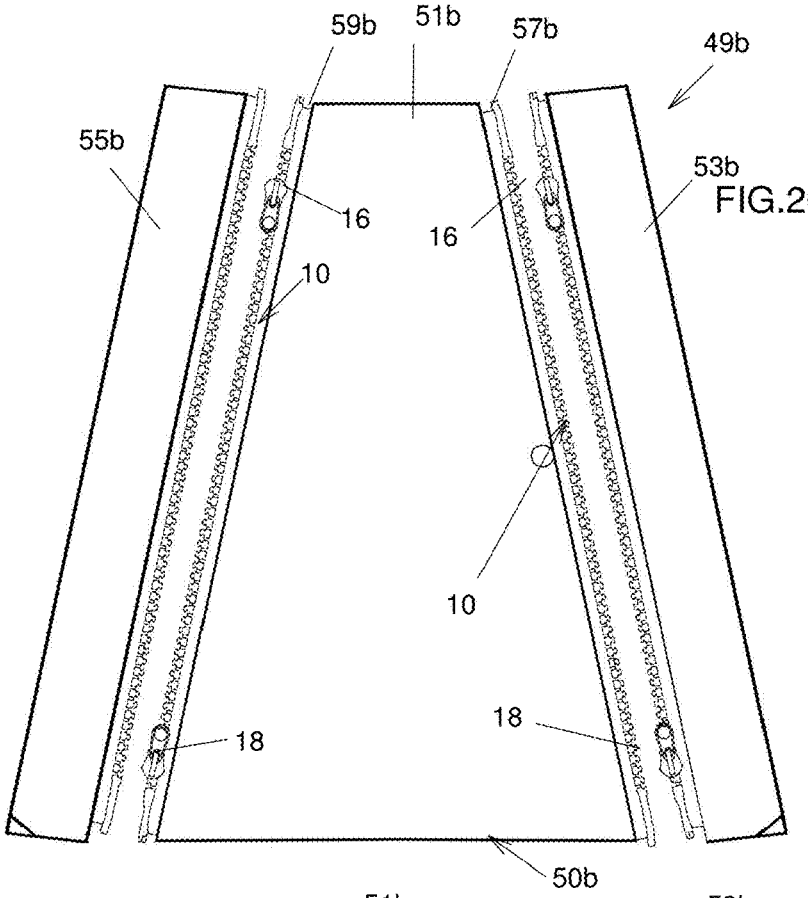
FIGS. 20 and 21 together illustrate rotation of the whole garment extender of FIG. 11 in the second configuration.
Figure 21:
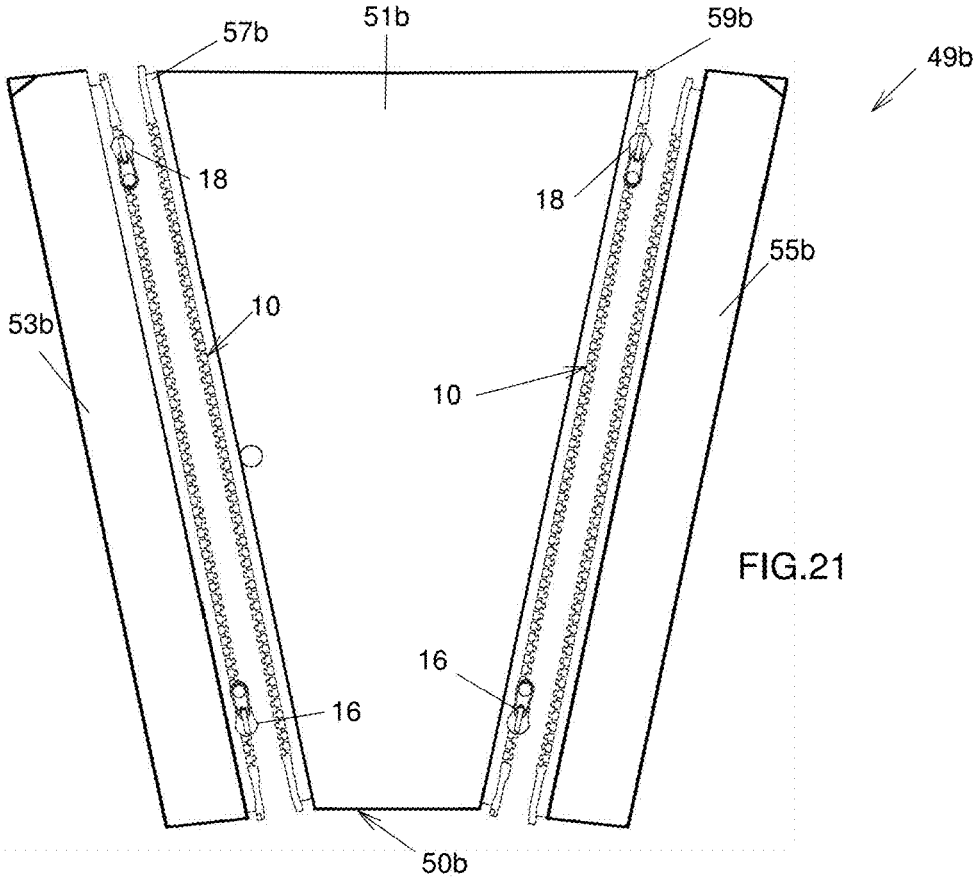

In the second configuration, seen in FIGS. 18 to 21, the central portion 51*b* includes the first and second sliders 16 and 18 on one of the central portion sides 57*b* or 59*b* and omits the first and second sliders 16 and 18 on the other one of the central portion sides 57*b* or 59*b*. The first and second sliders 16 and 18 are present on the lateral portion 53*b* or 55*b* facing the central portion side 57*b* or 59*b* on which the first and second sliders are omitted, and are omitted on the other one of the lateral portion 53*b* or 55*b*. In this configuration, the central portion 51*b* may be removed to achieve the configuration of FIG. 12. In this configuration, exchanging the top and bottom ends of the central portion may be performed by flipping back to front the central portion 51*b* without detaching the lateral portions 53*b* and 55*b* from the garment, as seen in FIGS. 18 and 19, but rotation cannot occur without such a detachment and requires rotating the whole garment extender 49*b*, as seen in FIGS. 20 and 21.

Figure 22:
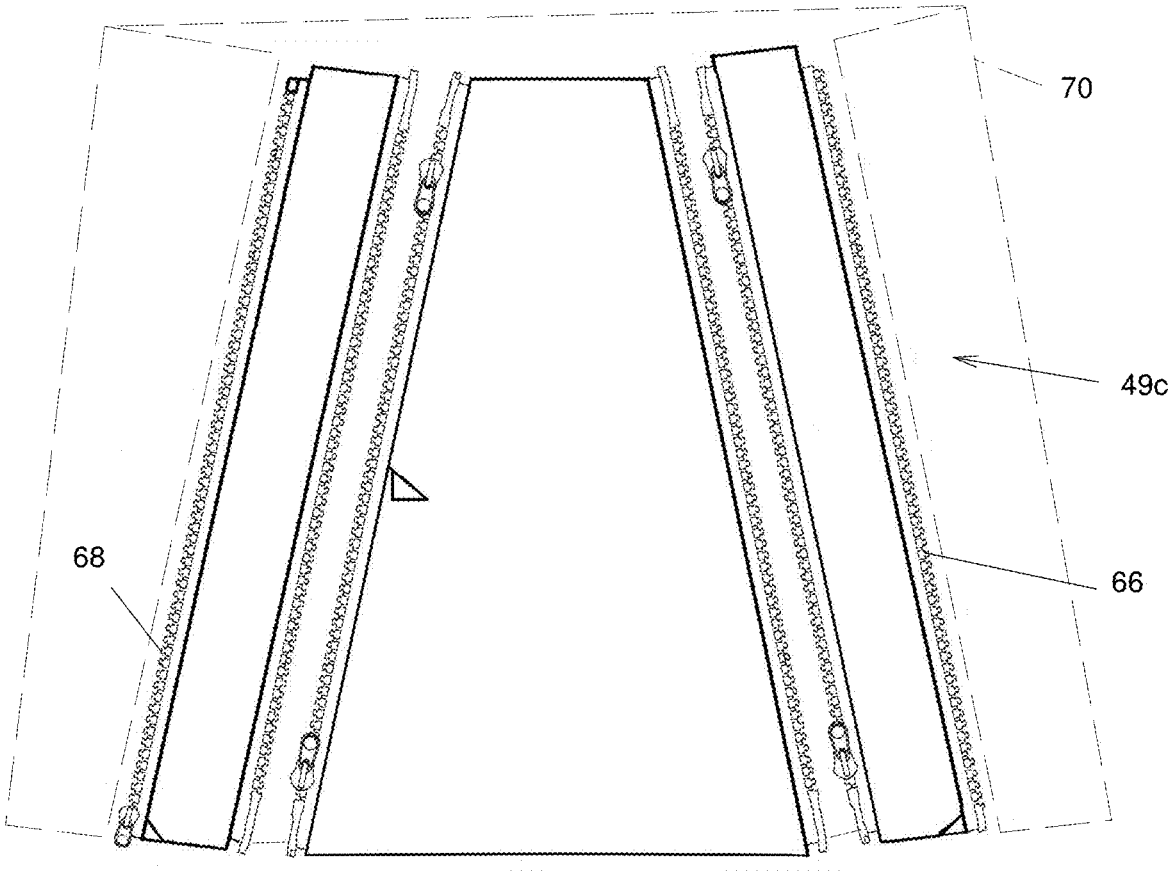
FIG. 22, in a front elevation view, illustrates a garment extender in accordance with yet another embodiment of the invention.

As seen in FIG. 22, in some embodiments, a garment extender 49*c*, similar to the garment extender 49*b*, includes attachments 66 and 68 at the extreme lateral sides thereof in the form of slide fastener halves configured to attach to the already present slide fastener of the garment to which the garment extender 49*c* is attached. Such attachments 66 and 68 are also usable in the garment extenders 49, 49*a* and 49*b*. In alternative embodiments not shown in the drawings these attachments 66 and 68 include instead clips mountable to the stringers or other portions of the garment 70.

Although the present invention has been described hereinabove by way of exemplary embodiments thereof, it will be readily appreciated that many modifications are possible in the exemplary embodiments without materially departing from the novel teachings and advantages of this invention. Accordingly, the scope of the claims should not be limited by the exemplary embodiments, but should be given the broadest interpretation consistent with the description as a whole.

What is claimed is:

1. A garment extender comprising:

a body, the body defining opposed body first and second ends and body first and second sides extending therebetween, the body first and second sides being provided each with a respective attachment for attaching the garment extender to a garment;

the body including body first, second and third panels, the body second panel being provided between the body first and third panels, and a first slide fastener between the body first and second panels, the first slide fastener extending between the body first and second ends to allow selective attachment of the body first and second panels to each other and detachment of the body first and second panels from each other;

the first slide fastener including:

a first stringer, the first stringer including a first tape secured to a first one of the body first and second panels and defining first tape first and second ends respectively at the body first and second ends, a plurality of first teeth being provided along the first tape between the first tape first and second ends;

a second stringer, the second stringer including a second tape secured to a second one of the body first and second panels and defining second tape first and second ends respectively at the body first and second ends, a plurality of second teeth being provided along the second tape between the second tape first and second ends;

first and second sliders, the first slider defining a first channel defining first channel wide and narrow ends, the second slider defining a second channel defining second channel wide and narrow ends, the first slider being operative for meshing to each other the first and second teeth when the first and second teeth move together relative to the first channel from the first channel wide end to the first channel narrow end and for separating from each other the first and second teeth when the first and second teeth move together relative to the first channel from the first channel narrow end to the first channel wide end, the second slider being operative for meshing to each other the first and second teeth when the first and second teeth move together relative to the second channel from the second channel wide end to the second channel narrow end and for separating from each other the first and second teeth when the first and second teeth move together relative to the second channel from the second channel narrow end to the second channel wide end;

the first and second sliders being mounted to the first stringer with the first and second channel narrow ends facing each other, the first and second channel wide ends facing respectively the first tape first and second ends;

wherein, with the first and second stringers detached from each other, the first and second stringers are attachable to each other by inserting the second stringer in the first and second channels and then meshing together the first and second teeth using one of the first and second sliders while starting at either one of the first tape first and second ends;

the body further comprising a second slide fastener similar to the first slide fastener between the body second and third panels and extending between the body first and second ends to allow selective attachment of the body second and third panels to each other and detachment of the body second and third panels from each other.

2. The garment extender as defined in claim 1, wherein, with the first and second stringers attached to each other and the first and second sliders respectively at the first tape first and second ends, the first and second stringers are detachable from each other by moving both the first and second sliders adjacent either one of the first tape first and second ends and then removing the second stringer from the first and second channels.

3. The garment extender as defined in claim 2, wherein, with the first and second stringers positioned adjacent each other, the first and second stringers are alternatively securable to each other in a first direction by moving the first and second sliders to the first tape first end, inserting the second stringer first in the second channel and then in the first channel, and subsequently moving the second slider towards the first tape second end; and securable to each other in a second direction by moving the first and second sliders to the first tape second end, inserting the second stringer first in the first channel and then in the second channel, and subsequently moving the first slider towards the first tape first end.

4. The garment extender as defined in claim 1, wherein the first tape is provided with a retainer pin at each end thereof preventing the first and second sliders from sliding out of the first stringer; and wherein the second tape is provided with a separable pin at each of the tape first and second ends, the separable pins being each insertable through both the first and second channels when the first and second sliders abut against each other to attach the first and second stringers to each other and removable from both the first and second channels when the first and second sliders abut against each other to detach the first and second stringers from each other.

5. The garment extender as defined in claim 1, wherein the body tapers in a direction leading from the body first end towards the body second end.

6. The garment extender as defined in claim 1, wherein the first stringers of the first and second slide fasteners are both mounted to the body second panel on opposite sides thereof and wherein the second stringers of the first and second slide fasteners are mounted respectively to the body first and third panels.

7. The garment extender as defined in claim 1, wherein the second stringers of the first and second slide fasteners are both mounted to the body second panel on opposite sides thereof and wherein the first stringers of the first and second slide fasteners are mounted respectively to the body first and third panels.

8. The garment extender as defined in claim 1, wherein the first stringers of the first and second slide fasteners are mounted respectively to the body second and third panels, and wherein the second stringers of the first and second slide fasteners are mounted respectively to the body first and second panels.

9. The garment extender as defined in claim 8, wherein the second panel defines opposed second panel first and second faces, the second panel first and second faces being made of different materials.

10. The garment extender as defined in claim 9, wherein the second panel first and second faces are respectively waterproof and made of a soft to touch material.

11. The garment extender as defined in claim 7, wherein the second panel defines opposed second panel first and second faces, the second panel first and second faces being made of different materials.

12. The garment extender as defined in claim 11, wherein the second panel first and second faces are respectively waterproof and made of a soft to touch material.

13. The slide fastener as defined in claim 4, wherein the retainer pin includes a pin body of substantially constant thickness therealong and a retainer protruding from the pin body to produce a thicker portion thicker than the remainder of the retainer pin.

14. The slide fastener as defined in claim 4, wherein the retainer and separable pins have substantially identical pin lengths.

15. The slide fastener as defined in claim 14, wherein the pin lengths are substantially equal to a combined length of the first and second channels.

16. A garment extender comprising:

a body, the body defining opposed body first and second ends and body first and second sides extending therebetween, the body first and second sides being provided each with a respective attachment for attaching the garment extender to a garment;

the body including body first and second panels and a slide fastener between the body first and second panels between the body first and second ends to allow selective attachment of the body first and second panels to each other and detachment of the body first and second panels from each other;

the slide fastener including:

a first stringer, the first stringer including a first tape secured to the body first panel and defining first tape first and second ends respectively at the body first and second ends, a plurality of first teeth being provided along the first tape between the first tape first and second ends;

a second stringer, the second stringer including a second tape secured to the body second panel and defining second tape first and second ends respectively at the body first and second ends, a plurality of second teeth being provided along the second tape between the second tape first and second ends;

first and second sliders, the first slider defining a first channel defining first channel wide and narrow ends, the second slider defining a second channel defining second channel wide and narrow ends, the first slider being operative for meshing to each other the first and second teeth when the first and second teeth move together relative to the first channel from the first channel wide end to the first channel narrow end and for separating from each other the first and second teeth when the first and second teeth move together relative to the first channel from the first channel narrow end to the first channel wide end, the second slider being operative for meshing to each other the first and second teeth when the first and second teeth move together relative to the second channel from the second channel wide end to the second channel narrow end and for separating from each other the first and second teeth when the first and second teeth move together relative to the second channel from the second channel narrow end to the second channel wide end;

the first and second sliders being mounted to the first stringer with the first and second channel narrow ends facing each other, the first and second channel wide ends facing respectively the first tape first and second ends;

wherein, with the first and second stringers detached from each other, the first and second stringers are attachable to each other by inserting the second stringer in the first and second channels and then meshing together the first and second teeth using one of the first and second sliders while starting at either one of the first tape first and second ends.

* * * * *